United States Patent [19]

Verrelli

[11] Patent Number: 4,715,489

[45] Date of Patent: Dec. 29, 1987

[54] DISK OPERATED PLASTIC BAG DISPENSER

[75] Inventor: Loreto Verrelli, Burnaby, Canada

[73] Assignee: EBCO Industries Ltd., Canada

[21] Appl. No.: 747,087

[22] Filed: Jun. 20, 1985

[51] Int. Cl.[4] ..... G07F 11/00; G07F 5/02

[52] U.S. Cl. ..... 194/256; 194/257; 194/258; 221/312 A

[58] Field of Search ..... 194/254, 256, 247, 249, 194/253, 255, 257, 258; 221/312 A, 289, 301, 312 R, 312 B

[56] References Cited

U.S. PATENT DOCUMENTS

| | | | |
|---|---|---|---|
| 694,960 | 3/1902 | Grey | 194/254 |
| 892,683 | 7/1908 | Rast et al. | 194/256 |
| 1,102,894 | 7/1914 | Erwin et al. | 194/254 |
| 1,219,861 | 3/1917 | Payne et al. | 194/264 |
| 1,250,179 | 12/1917 | Hughes et al. | 194/256 |
| 1,258,765 | 3/1918 | Grover | 194/277 |
| 1,267,662 | 5/1918 | Heghinian | 194/254 |
| 1,935,773 | 11/1933 | Goodman | 194/261 |
| 1,948,107 | 2/1934 | Gilchrist et al. | 194/227 |
| 2,034,484 | 3/1936 | Pagendarm | 194/244 X |
| 2,280,580 | 4/1942 | Harris | 194/261 |
| 2,930,510 | 3/1960 | Pallissard | 221/289 |
| 3,050,214 | 8/1962 | Kopf | 194/253 X |
| 3,051,286 | 8/1962 | Stange et al. | 194/240 |
| 3,119,484 | 1/1964 | Davis et al. | 194/255 |
| 3,176,817 | 4/1965 | Perrella et al. | 221/312 A |
| 3,379,296 | 4/1968 | Brenner | 194/240 |
| 3,503,481 | 3/1970 | Brenner | 194/240 |
| 3,749,218 | 7/1973 | Verbeke | 194/247 |
| 3,799,395 | 3/1974 | Vanderpool | 221/289 |
| 3,946,848 | 3/1976 | Knickerbocker | 194/227 |
| 4,189,044 | 2/1980 | Armstrong et al. | 221/312 A X |

*Primary Examiner*—Joseph J. Rolla
*Assistant Examiner*—Edward S. Ammeen
*Attorney, Agent, or Firm*—Townsend & Townsend

[57] ABSTRACT

A disk operated mechanism having two pivotable members spaced apart by an amount less than the diameter of the disk. A lever extends from one pivotable member. Co-operable stops on each pivotable member restrict pivoting of the members when the lever is moved, thus restricting further movement of the lever. The arrangement ensures that a disk placed between the pivotable members will transmit force applied to one pivotable member by the lever to the other pivotable member to widen the spacing between the pivotable members so that the co-operable stops cannot contact each other to restrict pivoting of the members and thus movement of the lever.

9 Claims, 5 Drawing Figures

DISK OPERATED PLASTIC BAG DISPENSER

FIELD OF THE INVENTION

This invention relates to a disk operated mechanism, particularly a disk operated mechanism for use in a dispensing apparatus, typically for plastic bags. However the apparatus finds application wherever vending machines of this particular type are required, that is when the item to be sold can conveniently be temporarily trapped on a dispensing machine and released by insertion of a coin into the machine.

DESCRIPTION OF THE PRIOR ART

Many stores sell plastic bags, formed with handles, for the benefit of their customers. Typically in North America the bags cost a quarter. The bags are located on a machine. Any one wishing to buy a bag simply inserts a quarter into the machine and then lifts the bag from the machine, the coin releasing the bag in a manner common for vending machines.

Unfortunately such vending machines are complicated, prone to failure and require considerable maintenance.

There have been efforts made to improve such dispensing or vending machines and the prior art known to applicants comprises U.S. Pat. Nos. 3,946,848 to Knickerbocker; 1,948,107 to Gilchrist; 2,280,580 to Harris; 2,034,484 to Pagendarm; 1,935,773 to Goodman; 1,258,765 to Grover; and 1,219,861 to Payne.

However it is felt that all the prior art listed above still displays, in one way or another, the disadvantages outlined above, that is they are relatively complicated pieces of equipment. Grover discloses a device where the movement of a coin between a hand lever and a pawl facilitates actuation of the device. But Grover is a relatively complicated system. Dane disclosed a spring bias catch member moving under the weight of the coin. Knickerbocker, Gilchrist and Goodman all disclosed coin operated devices in which the coins bias a lever or rachet downwardly.

Generally speaking it is undesirable to have mechanisms that rely on the weight of the coin. Such mechanisms must be quite finely balanced and sensitive mechanisms in this environment are not desirable.

SUMMARY OF THE INVENTION

The present invention seeks to provide considerable simplification in mechanisms useful in vending machines.

Accordingly, in a first aspect, the present invention is a disk operated mechanism comprising two pivotable members spaced apart by an amount less than the diameter of the disk; a lever extending from one pivotable member; co-operable stops on each pivotable member able to restrict pivoting of the members when the lever is moved thus restricting further movement of the lever; the arrangement ensuring that a disk placed between the pivotable members will transmit force supplied to one pivotable member by the lever to the other pivotable member to widen the spacing between the pivotable members so that the co-operable stops can not contact each other to restrict pivoting of the members and thus movement of the lever.

In a more specific aspect the present invention is a disk operated mechanism comprising a first pivotable member; a lever formed on the first pivotable member; a first stop to restrict pivoting of the first pivotable member; resilient means urging the first pivotable member against the first stop; a second pivotable member, spaced from the first; a second stop to restrict pivoting of the second pivotable member; resilient means urging the second pivotable member against the second stop; cooperable stops on the first and second members able to abut each other to prevent the first member pivoting by more than a predetermined amount when a force is applied to the lever; but the first and second members being spaced apart by an amount that allows a disk of predetermined size to be received between them whereupon a force supplied to the lever, and thus the first member, is transmitted by the disk to the second member to pivot the second member sufficiently to ensure the cooperable stops do not abut when the first member is pivoted and thus do not restrict further movement of the lever.

In a yet further aspect the present invention is a coin operated bag dispenser comprising a stand; a first housing extending upwardly from the stand; a second housing extending upwardly from the stand, spaced from the first housing; a base member mounted within the first housing; a first pivotable member mounted on the base member; a lever extending from the first pivotable member out of the first housing and into the second housing; a first stop on the base to restrict pivoting of the first pivotable member; resilient means urging the first pivotable member against the first stop; a second pivotable member mounted on the base member and spaced from the first pivotable member; a second stop on the base to restrict pivoting of the second pivotable member; resilient means urging the second pivotable member against the second stop; co-operable stops on the first and second members able to abut each other to prevent the first member pivoting by more than a predetermined amount when a force is applied to the lever; but the first and second members being spaced apart by an amount that allows a disk of predetermined size to rest between them whereupon a force applied to the lever, and thus the first member, is transmitted by the disk to the second member to pivot the second member sufficient to ensure the co-operable stops do not abut when the first member is pivoted by the lever and thus do not restrict further movement of the lever.

It is desirable that the first stop, in the above second and third aspects of the present invention, be movable to allow pivoting of the first pivotable member past the point defined by the first stop. This feature is desirable to facilitate loading of the machine with bags. This can be achieved by forming the stop with a downwardly extending limb. A lever contacts the limb to move the stop out of contact with the first pivotable member. There are means, for example a coil spring, urging the lever back into contact with the first pivotable member.

DRAWINGS

Aspects of the invention are illustrated, merely by way of example, in the accompanying drawings in which.

DESCRIPTION OF THE PREFERRED EMBODIMENTS

Figure 1:
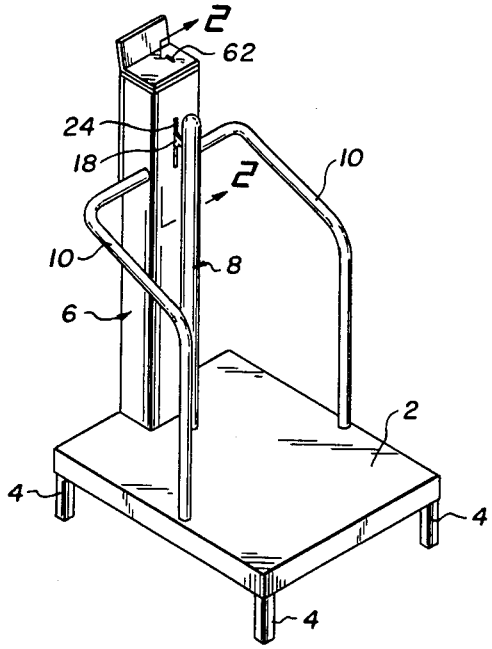
FIG. 1 is an overall view of a coin operated bag dispenser according to one aspect of the present invention.

FIG. 1 shows a coin operated bag dispenser comprising of stand 2, formed with legs 4, and with a first housing 6 extending upwardly from the stand 2. A second housing 8 also extends upwardly from the stand 2, spaced from the first housing 6. The stand is formed with guide rails 10, to assist in locating the bags, but these guide rails 10 do not form any part of the present invention.

Figure 2:
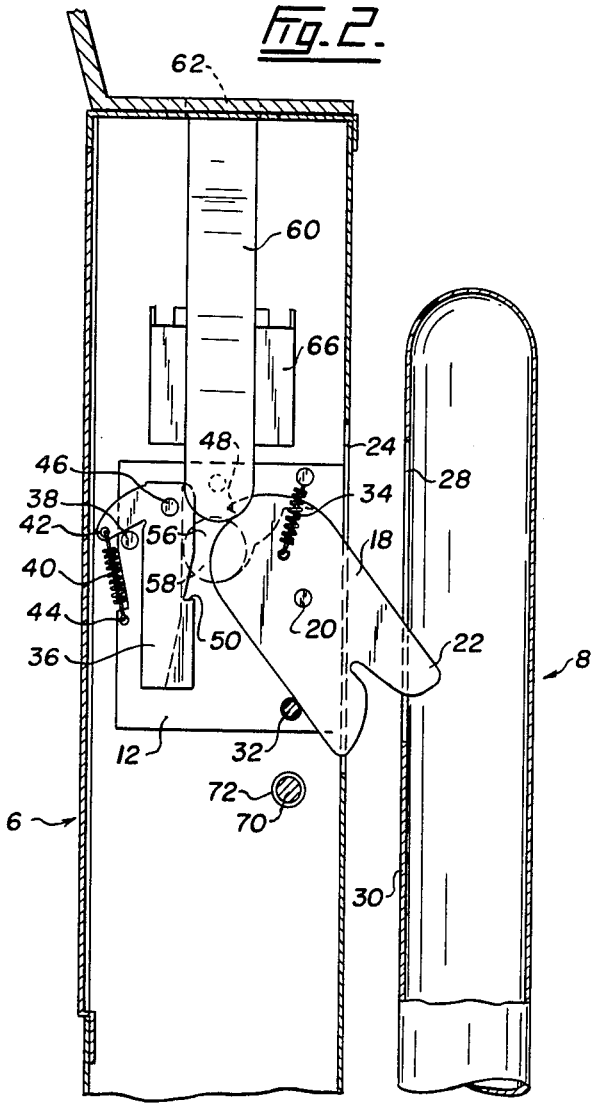
FIG. 2 is section on the line 2—2 in FIG. 1.
Figure 4:
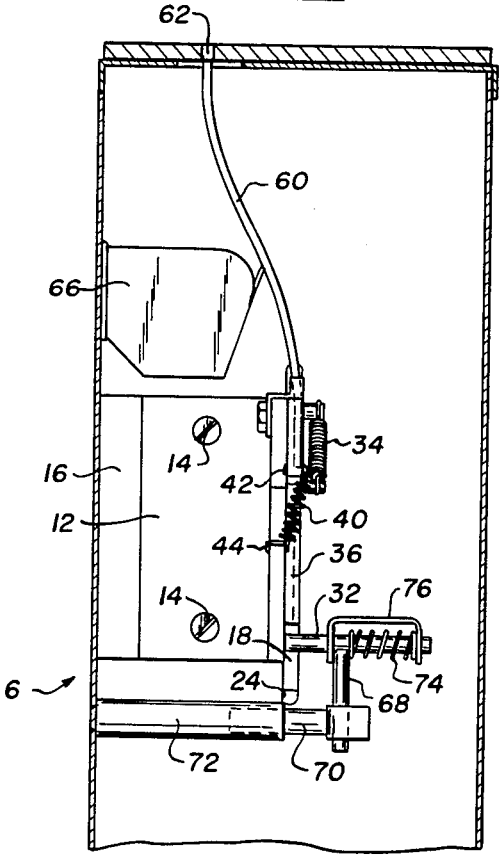
FIG. 4 is a detail of the apparatus of FIG. 1.

As shown particularly in FIGS. 2 and 4 there is a base member 12 mounted within the first housing 6 by screws 14 engaging plate 16 located on the interior of the housing 6.

A first pivotable member 18 is mounted on the base member 12 to pivot about 20. The first pivotable member has a lever 22 extending from it, out of an opening 24 formed in the front face of the housing 6 and into an opening 28 formed in the rear 30 of the second housing 8. As shown particularly in FIG. 2 there is a first stop 32 on the base member 12 to restrict pivoting of the first pivotable member 18. Resilient means in the form of coil spring 34 urges the first pivotable member 18 against the first stop 32.

A second pivotable member 36 is mounted on the base member 12 spaced from the first pivotable member 18. There is a second stop 38 on the base member 12 to restrict pivoting of the second pivotable member 36 and resilient means, again in the form of a coil spring 40, engages the second pivotable member 36 at 42 and the base member 12 at 44, to urge the second pivotable member 36 against the second stop 38. The second pivotable member 36 pivots about 46.

Figure 5:
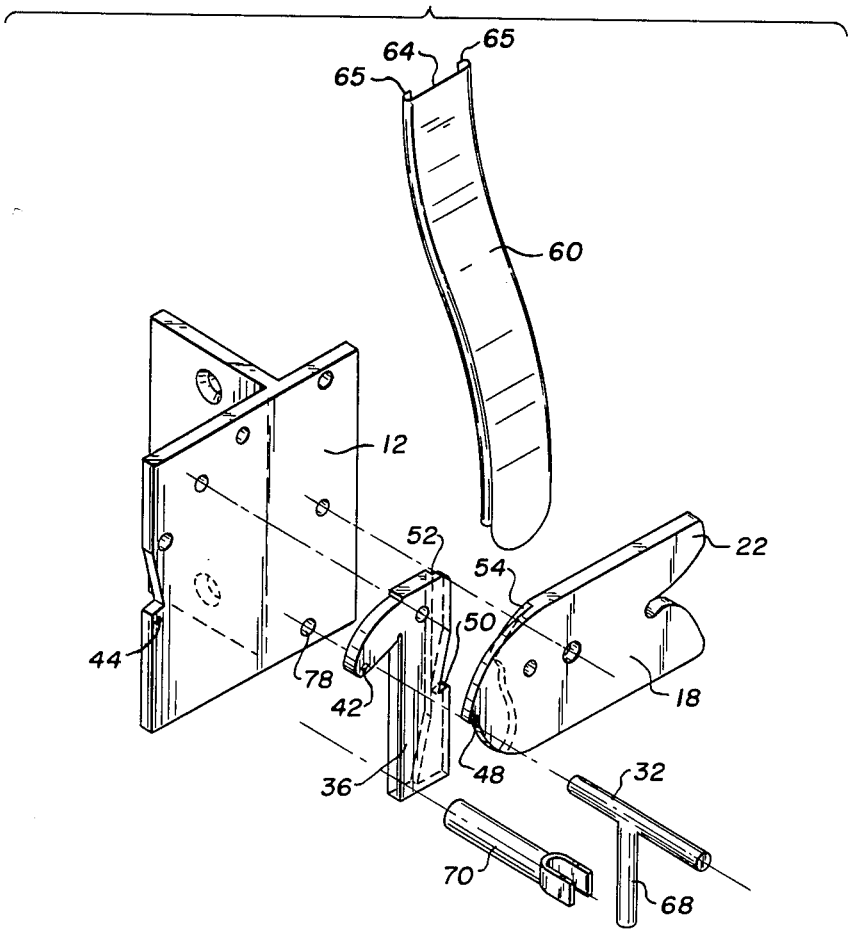
FIG. 5 is an exploded view of the mechanism according to the present invention.

As shown most clearly in FIGS. 2 and 5 there are co-operable stops on the first and second pivotable members 18 and 36. A stop 48 projects from the first pivotable member 18. The position shown in FIG. 2 is such that if an upward force is applied to the lever 22 than the lever pivots, moving the stop 48 downwardly until it contacts a stop 50 in the form of an indent formed in the second pivotable member 36. This ensures the lever 22 cannot be moved upwardly sufficient to release an item trapped between the first and second housing 6 and 8.

Figure 3:
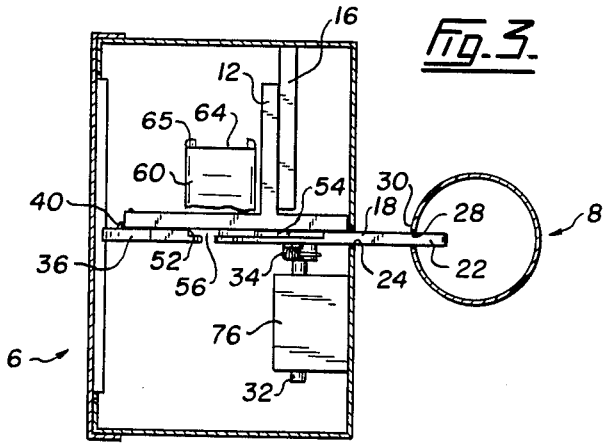
FIG. 3 is a partial section, in plan of the aparatus of FIG. 2.

As shown particularly in FIGS. 3 and 5 the first and second pivotable members 18 and 36 are adapted, by the formation of recesses 52 and 54 on the sides adjacent the base member 12, to form a channel 56, with the base 12, to hold a disk 58. FIG. 2 shows the formation of the channel 56 and the receipt of a disk 58 in the lower part of the channel.

The apparatus has a chute 60 extending from a disk or coin slot 62 (see FIG. 4) in the upper surface of the first housing 6. As shown in FIG. 5 the coin chute 60 extends from the slot 62 to the channel 56 between the first and second members 18 and 36. The chute 60 is formed with an open face 64 with folded sides 65 extending upwardly and over the open face 64. FIG. 5 shows that the open face 64 of the chute 60 extends downwardly for at least part of its length. A coin reject box 66 is positioned beneath the open face 64 of the chute 60.

FIGS. 4 and 5 show that the first stop 32 for the first pivotable member 18 can be moved to allow pivoting of the first pivotable member 18 past the point defined by the first stop 32. This arrangement is to facilitate loading of the apparatus. The first stop 32 is formed with a downwardly extending limb 68 that is contacted by a lever 70 slidably received within tubular housing 72 shown in FIG. 4. Housing 72 is open to the exterior of the housing so that a probe (not shown) can be inserted into the housing to move the lever 70 longitudinally of the tubular housing 72 to allow the first movable member 18 to pivot past the position formerly defined by the first stop 32. Coil spring 74, abutting bracket 76, acts to urge the first stop 32 into its rest position. Recess 78 is provided in the base member 12 to receive the first lever 32 in FIG. 5.

The mechanism of the present invention functions as follows:

FIG. 2 shows the mechanism in its rest position. Lever 22 extends out of the first housing 6, into the second housing 8. To load the machine with bags the handles of the bags are placed over the second housing 8, with the handles in the gap between the first and second housings 6 and 8. A probe is inserted into the tubular housing 72, from the outside of the first housing 6 and the first stop 32 is thus moved away from the base member 12 against the urging of spring 74. Downward pressure applied to the bag handles then permits the first lever 22 to pivot past the position defined by the stop 32 so that the lever leaves a space adjacent the second housing 8 to allow the bag handles to pass down to the stand 2 of the machine. When the force is removed, that is when the bags are moved past the lever 22, spring 34 urges the lever 22 upwardly, into the position shown in FIG. 2, that is received within the second housing 8. The probe is removed from the tubular housing 72 to allow spring 74 to urge the first stop 32 back to its rest position as shown in FIGS. 2 and 4. In this rest position the lever 22 cannot be move downwardly further than the position shown in FIG. 2, that is the lever 22 blocks the gap between the first and second housing 6 and 8.

To release a bag from the machine a disk 58 of predetermined size, typically a quarter, is inserted into the slot 62 into the chute 60 to the channel 56 formed between the first and second pivotable members 18 and 36. The disk 58 rests in the position shown in FIG. 2, that is the first and second pivotable members 18 and 36 are spaced apart by an amount that allows the disk 58 to be received between them. When a force is applied to the lever 22, for example by lifting a bag upwardly against the underside of the lever 22, the first member 18 is pivoted about 20. The pivoting force applied to the first member 18 is transmitted by the disk 58 to the second member 36 and the second member 36 pivots sufficiently about 46 to ensure that as continued movement is applied to the lever 22 the co-operable stops 48 and 50 do not abut each other but pass by each other and thus do not restrict further movement to the lever 22. By this means the lever 22 can be raised sufficiently to allow a bag to be removed from between the first and second housings 6 and 8. When the bag has been moved past the lever 22, that is when the upward force is removed, the disk 56 passes down into the first housing 6, into a collecting box (not shown). Spring 34 urges the first member 18 and thus lever 22 back to its rest position against stop 32. Spring 40 urges second number 36 back to its rest position in against stop 38.

The chute 60 acts as a simple but effective reject mechanism. For example if a coin of the incorrect denomination, and thus incorrect size, is placed in the opening 62 it cannot be retained by the sides 65 of the chute 60 and will drop into the reject coin box 66, through the open face 64 of the chute 60.

It should also be noted that even if this simple reject mechanism does not work the coin will not be sufficiently large to act as a force transmitter between the first and second pivotable members 18 and 36. That is if lever 22 is moved upwardly the coin will be too small to transmit the force to the second pivotable member to move it sufficiently to allow co-operable stops 48 and 50 to pass by each other.

If necessary two mechanisms can be incorporated into one dispenser, for example if a dispenser requires 35¢ to release a bag or the like.

The present invention thus discloses a disk operated mechanism that is simple to operate, that does not depend on the weight of the coins involved but merely the dimensions. It does not require complicated features such as the optical sensing of a coin and tests have indicated that its failure rate is negligble. It can easily be made robustly and is well able to withstand the rigours of everyday use in a Department store.

We claim:

1. A disk operated mechanism comprising:

a first pivotable member;

a first lever formed on the first pivotable member;

a first stop to restrict pivoting of the first pivotable member, said first stop including means to permit its movement to allow pivoting of the first pivotable member past the first stop, said means to permit movement comprising a limb extending downwardly from the first stop, a second lever to contact the limb to move the stop out of contact with the first pivotable member and means urging the stop back into contact with the first pivotable member;

resilient means urging the first pivotable member against the first stop;

a second pivotable member, spaced from the first;

a second stop to restrict pivoting of the second pivotable member;

resilient means urging the second pivotable member against the second stop;

co-operable stops on the first and second members able to abut each other to prevent the first member pivoting by more than a predetermined amount when a force is applied to the first lever;

but the first and second members being spaced apart by an amount that allows a disk of predetermined size to be received between them, whereupon a force supplied to the first lever, and thus the first member, is transmitted by the disk to the second member to pivot the second member sufficiently to ensure the co-operable stops do not abut when the first member is pivoted and thus do not restrict further movement of the first lever.

2. A mechanism as claimed in claim 1 including a first housing holding the mechanism, with the first lever projecting from the housing.

3. A mechanism as claimed in claim 2 including a second housing to receive the projecting first lever, spaced from the first housing.

4. A mechanism as claimed in claim 1 in which the first and second pivotable members are mounted on a base.

5. A mechanism as claimed in claim 4 in which the first and second members are adapted to form a channel, with the base, to hold the disk.

6. A mechanism as claimed in claim 1 further including a chute to feed a disk to the first and second members.

7. A mechanism as claimed in claim 6 in which the chute has an open face with side runners to hold a disk of predetermined size;

the open face facing downwardly whereby disks of less than a predetermined size that enter the chute fall through the open face.

8. A mechanism as claimed in claim 7 including a box below the chute to receive fallen disks.

9. A coin operated bag dispenser comprising a stand;

a first housing extending upwardly from the stand;

a second housing extending upwardly from the stand, spaced from the first housing;

a base member mounted within the first housing;

a first pivotable member mounted on the base member;

a first lever extending from the first pivotable member out of the first housing into the second housing;

a first stop on the base member to restrict pivoting of the first pivotable member, said first stop including means to permit its movement to allow pivoting of the first pivotable member past the first stop, said means to permit movement comprising a limb extending downwardly from the first stop, a second lever to contact the limb to move the stop out of contact with the first pivotable member and means urging the stop back into contact with the first pivotable member;

resilient means urging the first pivotable member against the first stop;

a second pivotable member mounted on the base member and spaced from the first pivotable member;

a second stop on the base to restrict pivoting of the second pivotable member;

resilient means urging the second pivotable member against the second stop;

co-operable stops on the first and second members able to abut each other to prevent the pivotable members pivoting by more than a predetermined amount when a force is applied to the first lever;

but the first and second members being spaced apart by an amount that allows a coin of predetermined size to pass between them, whereupon a force applied to the first lever, and thus the first member, is transmitted by the coin to the second member to pivot the second member sufficiently to ensure that the co-operable stops do not abut when the first member is pivoted by the first lever and thus do not restrict further movement of the first lever.

* * * * *